US006639499B2

(12) United States Patent
Okita et al.

(10) Patent No.: US 6,639,499 B2
(45) Date of Patent: Oct. 28, 2003

(54) INDUCTANCE COMPONENT IN WHICH A PERMANENT MAGNET FOR APPLYING A MAGNETIC BIAS IS ARRANGED OUTSIDE AN EXCITATION COIL

(75) Inventors: Kazuyuki Okita, Sendai (JP); Teruhiko Fujiwara, Sendai (JP)

(73) Assignee: NEC Tokin Corporation, Sendai (JP)

( * ) Notice: Subject to any disclaimer, the term of this patent is extended or adjusted under 35 U.S.C. 154(b) by 0 days.

(21) Appl. No.: 09/943,729

(22) Filed: Aug. 31, 2001

(65) Prior Publication Data

US 2002/0050905 A1 May 2, 2002

(30) Foreign Application Priority Data

Sep. 8, 2000 (JP) ..... 2000-274184

(51) Int. Cl.[7] ..... H01F 21/00; H01F 27/24
(52) U.S. Cl. ..... 336/110; 336/212; 336/178
(58) Field of Search ..... 336/212, 110, 336/178

(56) References Cited

U.S. PATENT DOCUMENTS 3,968,465 A * 7/1976 Fukui et al. ..... 336/110
4,009,460 A * 2/1977 Fukui et al. ..... 336/110
5,200,727 A * 4/1993 Katoh et al. ..... 335/222
5,642,249 A * 6/1997 Kuznetsov ..... 361/58
5,657,190 A * 8/1997 Araki et al. ..... 360/113
6,304,460 B1 * 10/2001 Cuk ..... 363/16

FOREIGN PATENT DOCUMENTS

| | | |
|---|---|---|
| DE | 2 226 289 A | 1/1973 |
| EP | 0 243 862 A | 11/1987 |
| JP | 50-134173 | 1/1975 |

OTHER PUBLICATIONS

Patent Abstracts of Japan, vol. 017, No. 340, Jun. 28, 1993 and JP 05–047572 A (Yokogawa Electric Corp.), Feb. 26, 1993—Abstract only.

* cited by examiner

*Primary Examiner*—Anh Mai
(74) *Attorney, Agent, or Firm*—Frishauf, Holtz, Goodman & Chick, P.C.

(57) ABSTRACT

In an inductance component in which a cylindrical excitation coil (26) is fitted around a predetermined portion of a magnetic core (21) forming a magnetic path, a permanent magnet (25) is inserted into the magnetic path to apply a magnetic bias to the magnetic core. The permanent magnet is arranged outside the cylindrical excitation coil. It is preferable that the permanent magnet is spaced from the predetermined portion of the magnetic core along the magnetic path at least by a distance which corresponds to ½ of an average of inner diameters of the cylindrical excitation coil.

8 Claims, 4 Drawing Sheets

INDUCTANCE COMPONENT IN WHICH A PERMANENT MAGNET FOR APPLYING A MAGNETIC BIAS IS ARRANGED OUTSIDE AN EXCITATION COIL

BACKGROUND OF THE INVENTION

This invention relates to an electronic component utilizing inductance (hereinafter collectively called an "inductance component"), such as an inductor and a transformer used in a power supply for an electronic apparatus.

Year after year, there arises an increasing demand for an electronic component which is reduced in size and increased in power density. For an inductance component, various proposals have been made to meet the above-mentioned demand. For example, Japanese Unexamined Patent Publication No. S50-134173 (JP 50-134173 A) discloses an inductance component comprising a magnetic core and a permanent magnet attached thereto to apply a magnetic bias to the magnetic core so that the inductance is adjusted or controlled.

The inductance component includes two E-shaped magnetic cores faced to each other. The E-shaped magnetic cores have center magnetic legs faced to each other through the permanent magnet. To the center magnetic legs and the permanent magnet, a cylindrical excitation coil is fitted. Thus, the permanent magnet is arranged inside the cylindrical excitation coil. The permanent magnet generates a first magnetic field in a first direction while the excitation coil generates a second magnetic field in a second direction opposite to the first direction.

The inductance component in which the permanent magnet is arranged inside the cylindrical excitation coil is disadvantageous in the following respect. Upon occurrence of an abnormal current such as an inrush current rushing in or flowing through the excitation coil, the permanent magnet may possibly be demagnetized to become unable to exhibit the magnetic biasing effect, as will later be described in detail with reference to the drawing.

SUMMARY OF THE INVENTION

It is therefore an object of this invention to provide an inductance component in which demagnetization of a permanent magnet for applying a magnetic bias is suppressed.

It is another object of this invention to provide the above-mentioned inductance component small in size and high in power density.

Other objects of the present invention will become clear as the description proceeds.

According to this invention, there is provided an inductance component comprising a magnetic core forming a magnetic path, a cylindrical excitation coil fitted around a predetermined portion of the magnetic core, and a permanent magnet inserted into the magnetic path to apply a magnetic bias to the magnetic core, the permanent magnet being arranged outside the cylindrical excitation coil.

DETAILED DESCRIPTION OF THE DRAWING

DESCRIPTION OF THE PREFERRED EMBODIMENTS

For facilitating an understanding of this invention, description will at first be made as regards an existing inductance component.

Figure 1:
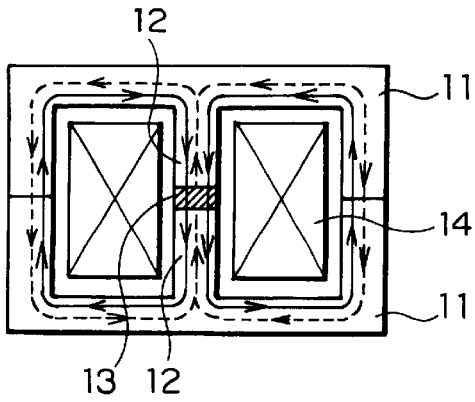
FIG. 1 PRIOR ART
FIG. 1 is a front view of an existing inductance component.

Referring to FIG. 1, the inductance component being illustrated in the figure corresponds to that disclosed in the Japanese Unexamined Patent Publication No. S50-134173 mentioned above. The inductance component illustrated in FIG. 1 comprises two E-shaped magnetic cores 11 butted to each other to form a magnetic path. The E-shaped magnetic cores 11 have center magnetic legs 12 faced to each other through a permanent magnet 13. Thus, the permanent magnet 13 is inserted in cascade or in series into the magnetic path.

Around the center magnetic legs 12 and the permanent magnet 13, a cylindrical excitation coil 14 is fitted. Thus, the permanent magnet 13 is arranged inside the excitation coil 14. The permanent magnet 13 generates a first magnetic field having a first direction (depicted by solid line arrows) while and the excitation coil 14 generates a second magnetic field having a second direction (depicted by broken line arrows) which is opposite to the first direction.

Each of the E-shaped magnetic cores 11 is made of Mn—Zn series ferrite. A combination of the E-shaped magnetic cores 11 forms a magnetic path having a length of 1.1 cm and an effective sectional area of 0.1 $cm^2$. The permanent magnet 13 is a SmFeN bonded magnet which has a coercive force of 398 A/m or more and a volume resistivity of 0.01 Ω·m or more and which is made from material powder having a particle size of 150 μm or less. The permanent magnet 13 has a thickness of 50 μm and a sectional area of 0.1 $cm^2$.

Figure 2:
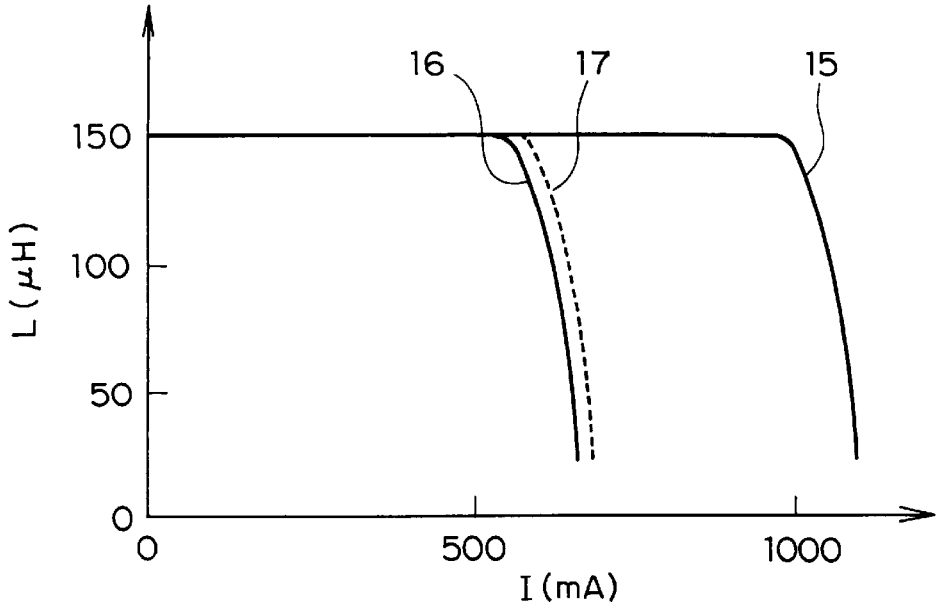
FIG. 2 is a graph showing the result of measurement of a DC superposition or DC bias characteristic of the inductance component illustrated in FIG. 1.

Referring to FIG. 2, the inductance component illustrated in FIG. 1 has a DC superposition or DC bias characteristic depicted by a solid line 15. Another inductance component in which the permanent magnet 13 is not arranged, i.e., the center magnetic legs 12 of the E-shaped magnetic cores 11 are faced to each other through a gap has a DC superposition characteristic depicted by a solid line 16 in FIG. 2. From comparison between the solid lines 15 and 16, it will be understood that the DC superposition characteristic of the inductance component in FIG. 1 is improved by about 60%.

Figure 3:
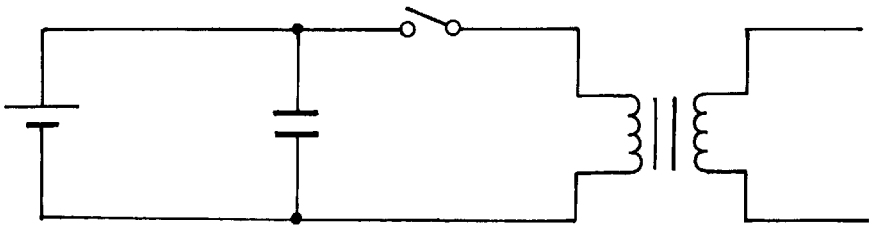
FIG. 3 is a circuit diagram of an electric circuit to which the inductance component is inserted as a transformer.

Referring to FIG. 3, the inductance component in FIG. 1 was experimentally inserted as a transformer into an electric circuit illustrated in the figure. When an abnormal current was produced in the transformer, the following problem arose. Herein, the excitation coil had a winding number of 32 turns and a DC resistance of 1 Ω and was applied with a voltage of 100V. In this event, the abnormal current caused in the transformer generated a magnetic field which demagnetized the permanent magnet. As a result, the DC superposition characteristic was deteriorated as depicted by a broken line 17 in FIG. 2. Thus, it has been confirmed that, under the above-mentioned condition, the inductance component with the permanent magnet was substantially similar in characteristic to the inductance component without the permanent magnet, i.e., with the gap alone.

Now referring to FIG. 4, the description will be made of an inductance component according to a first embodiment of this invention.

Figure 4:
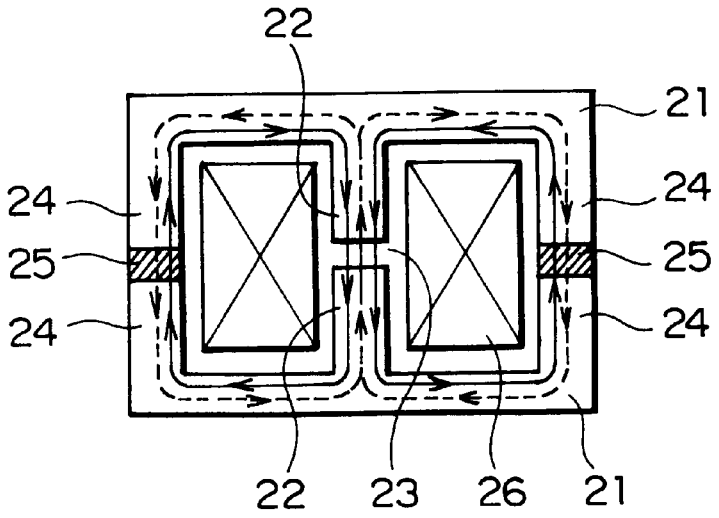
FIG. 4 is a front view of an inductance component according to a first embodiment of this invention.
Figure 5:
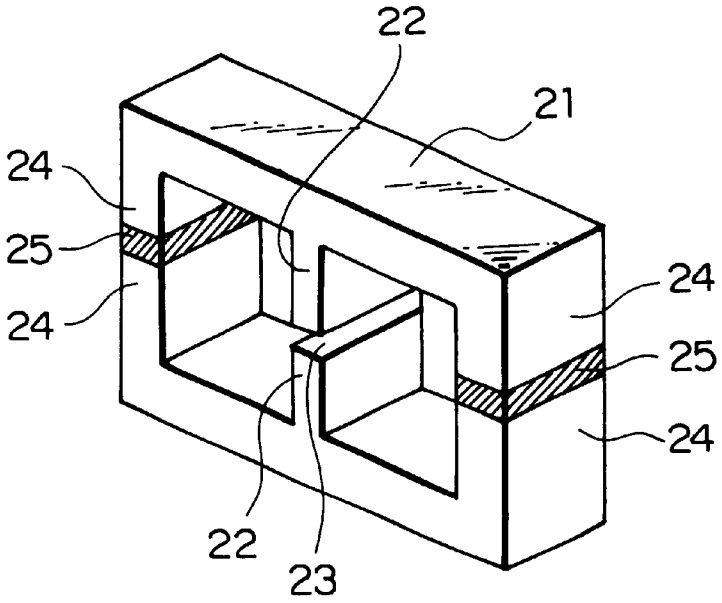
FIG. 5 is a perspective view of a magnetic core used in the inductance component illustrated in FIG. 4.

The inductance component illustrated in FIG. 4 comprises two E-shaped magnetic cores 21 butted to each other as illustrated in FIG. 5 to form a magnetic path. A combination of the E-shaped magnetic cores 21 is referred to as a magnetic core. The E-shaped magnetic cores 21 have center magnetic legs 22 faced to each other through a gap 23. Each of the E-shaped magnetic cores 21 has a pair of end magnetic legs 24. The end magnetic legs 24 of one of the E-shaped magnetic cores 21 are faced to those of the other E-shaped magnetic core 21 through a pair of permanent magnets 25, respectively. Thus, the permanent magnets 25 are inserted in cascade to the magnetic path to apply a magnetic bias to the magnetic core. The permanent magnets 25 are in contact with the magnetic core.

Around the center magnetic legs 22, a cylindrical excitation coil 26 is fitted. Thus, the permanent magnets 25 are arranged outside the excitation coil 26. The permanent magnets 25 generate a first magnetic field having a first direction (depicted by solid line arrows) while the excitation coil 26 generates a second magnetic field having a second direction (depicted by broken line arrows) opposite to the first direction.

Each of the E-shaped magnetic cores 21 is made of Mn—Zn series ferrite. A combination of the E-shaped magnetic cores 21 forms a magnetic path having a length of 1.1 cm and an effective sectional area of 0.1 $cm^2$. Each of the permanent magnets 25 is a SmFeN bonded magnet which has a coercive force of 398 A/m or more and a volume resistivity of 0.01 Ω·m or more and which is made from material powder having a particle size of 150 μm or less. Each of the permanent magnets 25 has a thickness of 50 μm and a sectional area of 0.1 $cm^2$. The permanent magnets 25 are magnetized after they are assembled to the E-shaped magnetic cores 21. The excitation coil 26 has a winding number of 32 turns and a DC resistance of 1 Ω.

Figure 6:
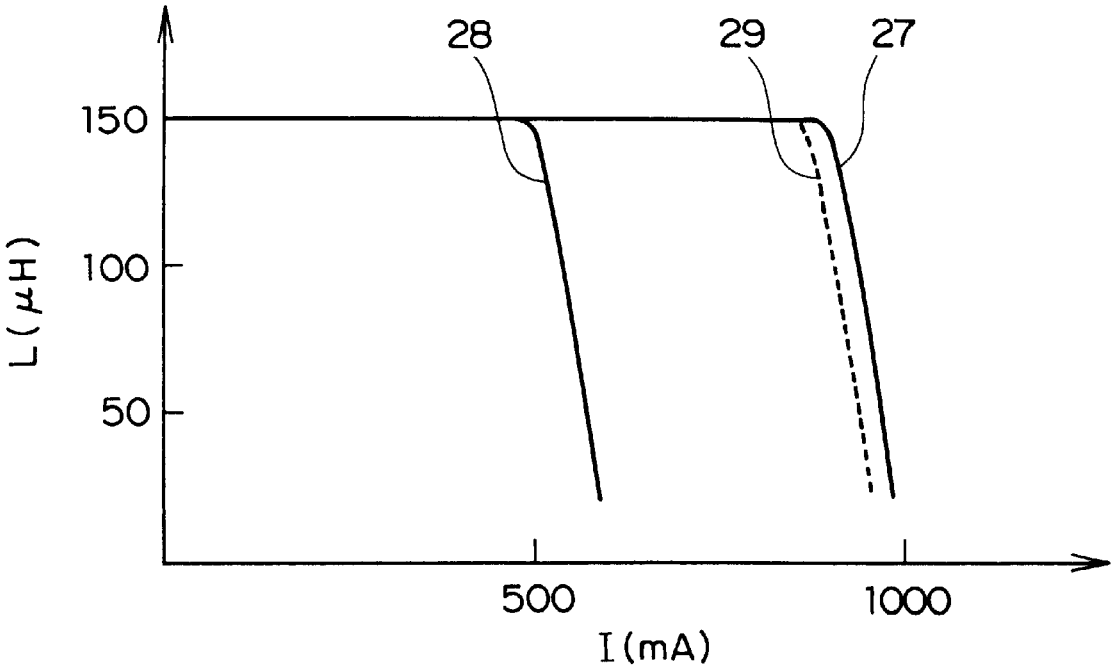
FIG. 6 is a graph showing the result of measurement of a DC superposition characteristic of the inductance component illustrated in FIG. 4.

Referring to FIG. 6, the inductance component illustrated in FIG. 4 has a DC superposition characteristic depicted by a solid line 27. In addition, another inductance component in which the permanent magnets 25 are not arranged, i.e., the end magnetic legs 24 of the E-shaped magnetic cores 21 are faced to each other through gaps has a DC superposition characteristic depicted by a solid line 28 in FIG. 6. From comparison between the solid lines 27 and 28, it will be understood that the DC superposition characteristic of the inductance component in FIG. 4 is improved by about 50%.

Experimentally, the inductance component in FIG. 4 was inserted as a transformer into the electric circuit illustrated in FIG. 3 and an abnormal electric current was produced in the transformer. Even under a strong magnetic field by the abnormal electric current, no substantial demagnetization of the permanent magnets was observed and the DC superposition characteristic depicted by a broken line 29 in FIG. 6 was achieved. Thus, it has been confirmed that the change in DC superposition characteristic was very small.

Furthermore, the transformer was mounted on a flyback converter having a frequency of 300 kHz and the maximum power density was measured. The result of measurement is shown in Table 1. It has been confirmed that the power density was increased by about 40%.

TABLE 1

| | Before Insertion of Permanent Magnet | After Insertion of Permanent Magnet |
|---|---|---|
| Maximum Power Density | 17.8 $MW/m^3$ | 25.4 $MW/m^3$ |

Next referring to FIG. 7, description will be made of an inductance component according to a second embodiment of this invention.

Figure 7:
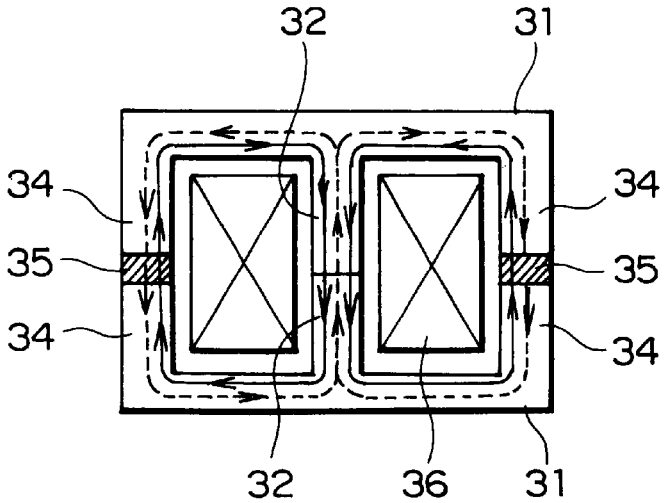
FIG. 7 is a front view of an inductance component according to a second embodiment of this invention.
Figure 8:
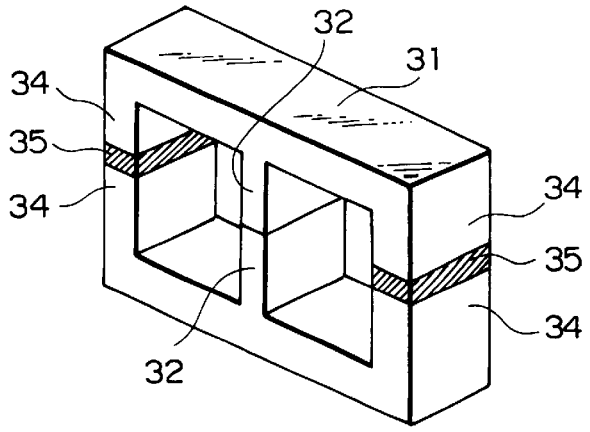
FIG. 8 is a perspective view of a magnetic core used in the inductance component illustrated in FIG. 7.

The inductance component illustrated in FIG. 7 comprises two E-shaped magnetic cores 31 butted to each other as illustrated in FIG. 8 to form a magnetic path. A combination of the E-shaped magnetic cores 31 is referred to as a magnetic core. The E-shaped magnetic cores 31 have center magnetic legs 32 faced to each other in contact with each other. Each of the E-shaped magnetic cores 31 has a pair of end magnetic legs 34. The end magnetic legs 34 of one of the E-shaped magnetic cores 31 are faced to those of the other E-shaped magnetic core 31 through a pair of permanent magnets 35, respectively. Thus, the permanent magnets 35 are inserted in cascade to the magnetic path to apply the magnetic bias to the magnetic core. The permanent magnets 35 are in contact with the magnetic core.

A cylindrical excitation coil 36 has an inner bore and is fitted around a predetermined portion of the center magnetic legs 32. In other words, the center magnetic legs 32 has a part as the predetermined portion inserted in the inner bore of the cylindrical excitation coil 36. Thus, the permanent magnets 35 are arranged outside the excitation coil 36. The permanent magnets 35 generate a first magnetic field having a first direction (depicted by solid line arrows) while the excitation coil 36 generates a second magnetic field having a second direction (depicted by broken line arrows) opposite to the first direction.

Each of the E-shaped magnetic cores 31 is made of Mn—Zn series ferrite. A combination of the E-shaped magnetic cores 31 forms a magnetic path having a length of 1.1 cm and an effective sectional area of 0.1 $cm^2$. The end magnetic legs 34 are subjected to grinding at their bonding surfaces so that the center magnetic legs 32 are brought into tight contact with each other. Each of the permanent magnets 35 is a rare earth permanent magnet, for example, a SmFeN bonded magnet which has a coercive force of 398 A/m or more and a volume resistivity of 0.01 Ω·m or more and which is made from material powder having a particle size of 150 μm or less. A SmCo magnet may be used as each of the permanent magnets 35. Each of the permanent magnets 35 has a thickness of 50 μm and a sectional area of 0.1 $cm^2$. The permanent magnets 35 are magnetized after they are assembled to the E-shaped magnetic cores 31. The excitation coil 36 has a winding number of 32 turns and a DC resistance of 1 Ω.

Figure 9:
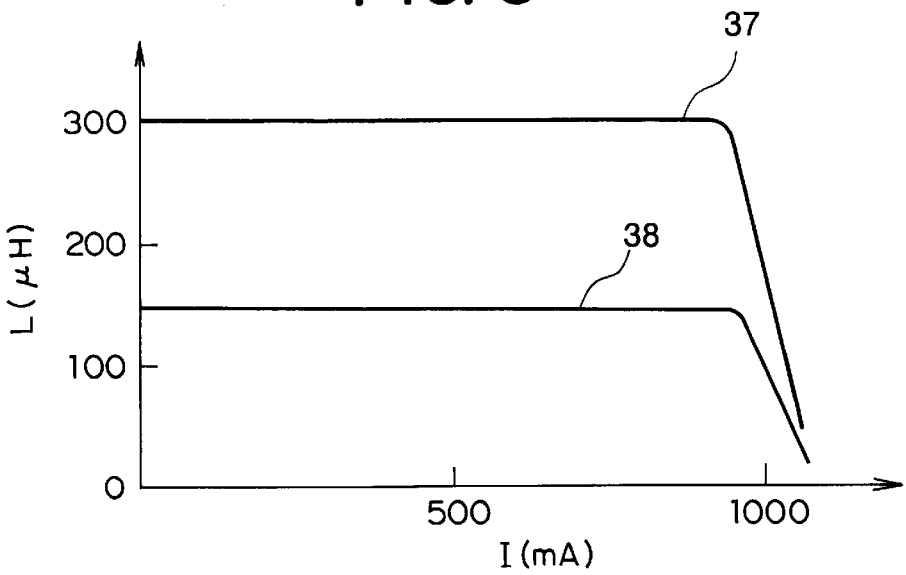
FIG. 9 is a graph showing the result of measurement of a DC superposition characteristic of the inductance component illustrated in FIG. 7.

Referring to FIG. 9, the inductance component illustrated in FIG. 7 has an improved inductance value depicted by a solid line 37. In addition, another inductance component in which the permanent magnets 35 are not arranged, i.e., the end magnetic legs 34 of the E-shaped magnetic cores 31 are faced to each other through gaps has a normal inductance value depicted by a solid line 38 in FIG. 9. From comparison between the solid lines 37 and 38, it will be understood that the improved inductance value is twice as large as the normal inductance value.

Experimentally, the inductance component in FIG. 7 was inserted as a transformer into the electric circuit illustrated in FIG. 3 and an abnormal electric current was produced in the transformer. Even under a strong magnetic field by the abnormal electric current, no substantial demagnetization of the permanent magnets was observed so that the inductance component was usable.

In the inductance components illustrated in FIGS. 4 and 7, the permanent magnets 25 and 35 are arranged outside the cylindrical excitation coils 26 and 36, respectively. As design modification, the permanent magnets 25 and 35 may be arranged at various positions as will presently be described.

Figure 10:
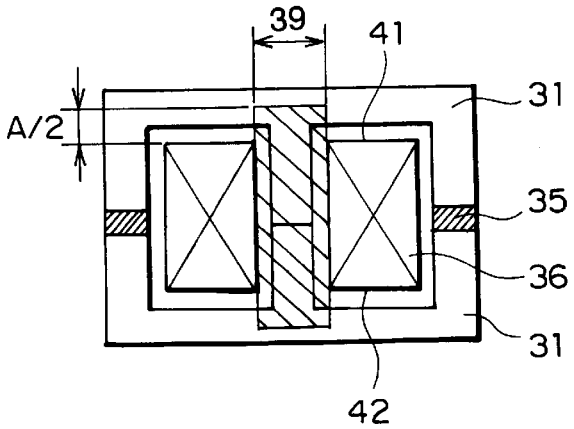
FIG. 10 is a view for describing a position of a permanent magnet in the inductance component illustrated in FIG. 7.

Referring to FIG. 10 showing the inductance component illustrated in FIG. 7, the description will be made as to positions of the permanent magnets 35. The inner bore of the cylindrical excitation coil 36 may have one of various shapes. It will be assumed here as a typical case that the inner bore is circular and has a diameter 39 corresponding to an average of diameters of the inner bore. In the typical case, the permanent magnets 35 are arranged selectively at positions spaced from axial ends 41 and 42 of the cylindrical excitation coil 36 along the magnetic path at least by a predetermined distance which corresponds to ½ of the diameter A. More particularly, the permanent magnets 35 is spaced from the predetermined portion of the center magnetic legs 32 along the magnetic path at least by the predetermined distance which. Thus, the permanent magnets 35 are preferably arranged in an area except a hatched area in FIG. 10. In the inductance component illustrated in FIG. 4 also, the positions of the permanent magnets 25 can be modified in the manner similar to that mentioned above in conjunction with the permanent magnets 35 in the inductance component in FIG. 7.

While the present invention has thus far been described in connection with a few embodiments thereof, it will readily be possible for those skilled in the art to put this invention into practice in various other manners. For example, although the SmFeN bonded magnet is used as the permanent magnet in the foregoing description, it will readily be understood that various other rare earth bonded magnet may be used instead. The above-mentioned inductance component can be implemented as an inductor or a transformer.

What is claimed is:

1. An inductance component comprising:

a magnetic core forming a magnetic path;

a cylindrical excitation coil fitted around a predetermined portion of said magnetic core; and a permanent magnet inserted into said magnetic path to apply a magnetic bias to said magnetic core, said permanent magnet being arranged outside said cylindrical excitation coil, wherein said permanent magnet is a rare earth permanent magnet which is made of material powder having a particle size of 150 $\mu$m or less and which has a coercive force of 398 A/m or more and a volume resistivity of 0.01 Ω·m or more.

2. The inductance component according to claim 1, wherein said permanent magnet is spaced from said predetermined portion of the magnetic core along said magnetic path at least by a distance which corresponds to ½ of an average of inner diameters of said cylindrical excitation coil.

3. The inductance component according to claim 1, wherein said permanent magnet is disposed at a given portion different from said predetermined portion.

4. The inductance component according to claim 3, wherein said permanent magnet is in contact with said magnetic core.

5. The inductance component according to claim 3, further comprising an additional magnet of another permanent magnet inserted into said magnetic path to apply an additional magnetic bias to said magnetic core, said additional magnet being disposed at another portion different from said given portion and said predetermined portion.

6. The inductance component according to claim 5, wherein said magnetic core includes two E-shaped magnetic cores each of which has a pair of end magnetic legs and a center magnetic leg between said end magnetic legs, said E-shaped magnetic cores being butted to each other so that said end magnetic legs and said center magnetic leg of one of said E-shaped magnetic cores are faced to those of the other E-shaped magnetic core, respectively, to thereby form said magnetic path in cooperation with each other, said cylindrical excitation coil being fitted around said center magnetic legs, the first-mentioned permanent and said additional magnets being inserted in gaps, respectively, left between said end magnetic legs of said E-shaped magnetic cores which are faced to each other.

7. The inductance component according to claim 6, wherein said center magnetic legs of said E-shaped magnetic cores are brought into contact with each other.

8. The inductance component according to claim 6, wherein said center magnetic legs of the E-shaped magnetic cores are spaced from each other.

* * * * *